US005404652A

United States Patent [19]

Sher

[11] Patent Number: 5,404,652

[45] Date of Patent: Apr. 11, 1995

[54] PORTABLE HEATER FOR PERSONAL USE

[76] Inventor: Jing-Dong Sher, 2Fl., No. 22, Chu Hai Rd., Taipei, Taiwan, Prov. of China

[21] Appl. No.: 275,390

[22] Filed: Jul. 15, 1994

[51] Int. Cl.[6] ..... F26B 19/00

[52] U.S. Cl. ..... 34/90; 362/92; 362/96; 34/97; 392/380

[58] Field of Search ..... 34/90, 91, 88, 97, 98; 362/92, 96, 294, 373; 392/379, 380, 383

[56] References Cited

U.S. PATENT DOCUMENTS 3,909,589 9/1975 Stone et al. ..... 362/92
4,307,701 12/1981 Balon et al. ..... 126/110
5,103,577 4/1992 Michaels et al. ..... 34/91

FOREIGN PATENT DOCUMENTS 1457415 1/1969 Germany ..... 34/97

*Primary Examiner*—Denise L. Gromada
*Assistant Examiner*—Susanne C. Tinker
*Attorney, Agent, or Firm*—Bacon & Thomas

[57] ABSTRACT

A portable heater including a heat generator and a fan device respectively mounted inside a housing and controlled by a respective switch to produce heat and an axial-flow of air for heating or drying the human body or clothes by means of air outlet pipes at one end of the housing, wherein the heat generator consists of a lamp bulb and a plurality of heat distribution devices surrounding the lamp bulb and disposed between the air outlet pipes and the fan device, each heat distribution device having a plurality of heat conductive radiating flanges for transmitting heat from the lamp bulb; the housing is covered with a light-permeable glass at one end through which the light of the lamp bulb passes for illumination.

2 Claims, 3 Drawing Sheets

PORTABLE HEATER FOR PERSONAL USE

BACKGROUND OF THE INVENTION

The present invention relates to a portable heater for personal use, and relates more particularly to such a portable heater which can be used as an air dryer as well as a portable lighting fixture.

Various portable heat generating apparatus are known and designed to attempt complete drying of the human body. For example, U.S. Pat. No. 4,307,701 discloses a portable heat distribution system which comprises a heater and a low velocity blower, a heat carrying duct and an intake fan unit for mixing the heated air from the portable heater with ambient air of the duct. The heater unit is comprised of a fuel tank supported upon a carriage having a pair of wheels. This structure of heat distribution system is heavy and huge, and therefore it is not suitable for carrying with the user as a personal item.

U.S. Pat. No. 5,103,577 discloses a body heater/drier which disperses warm air to the many users of the user by means of the operation of an electric heating wire and a fan/blower assembly. One drawback of this structure of body heater/drier is its high consumption of power supply. Another drawback of this structure of body heater/drier is that it has no means suitable for fastening to the user's body.

SUMMARY OF THE INVENTION

According to one aspect of the present invention, the portable heater has air tubes through which heated air can be guided into the space inside the clothes around the user's body to warm the user's body and dry the clothes. Therefore, this structure of portable heater is most suitable for motorcycle riders and the persons who wear a raincoat.

According to another aspect of the present invention, the portable heater has a self-provided battery power supply and a DC connector for connection to external battery power supply such as a car battery power supply. When an external battery power supply is used, the circuit of the self-provided battery power supply is automatically cut off.

According to still another aspect of the present invention, a lamp bulb is used as a heat source to generate heat when giving light, and radiating flanges are used to disperse heat from the lamp bulb efficiently. As a lamp bulb is used as a heat source, the portable heater can also be used as a portable electric light for illumination.

According to still another aspect of the present invention, a temperature detector is used to detect the inside temperature of the portable heater so as to automatically cut off power supply from the heat source when the detected temperature surpasses a predetermined value. Therefore, the service life of the heat source can be greatly prolonged.

DETAILED DESCRIPTION OF THE PREFERRED EMBODIMENT

Figure 1:
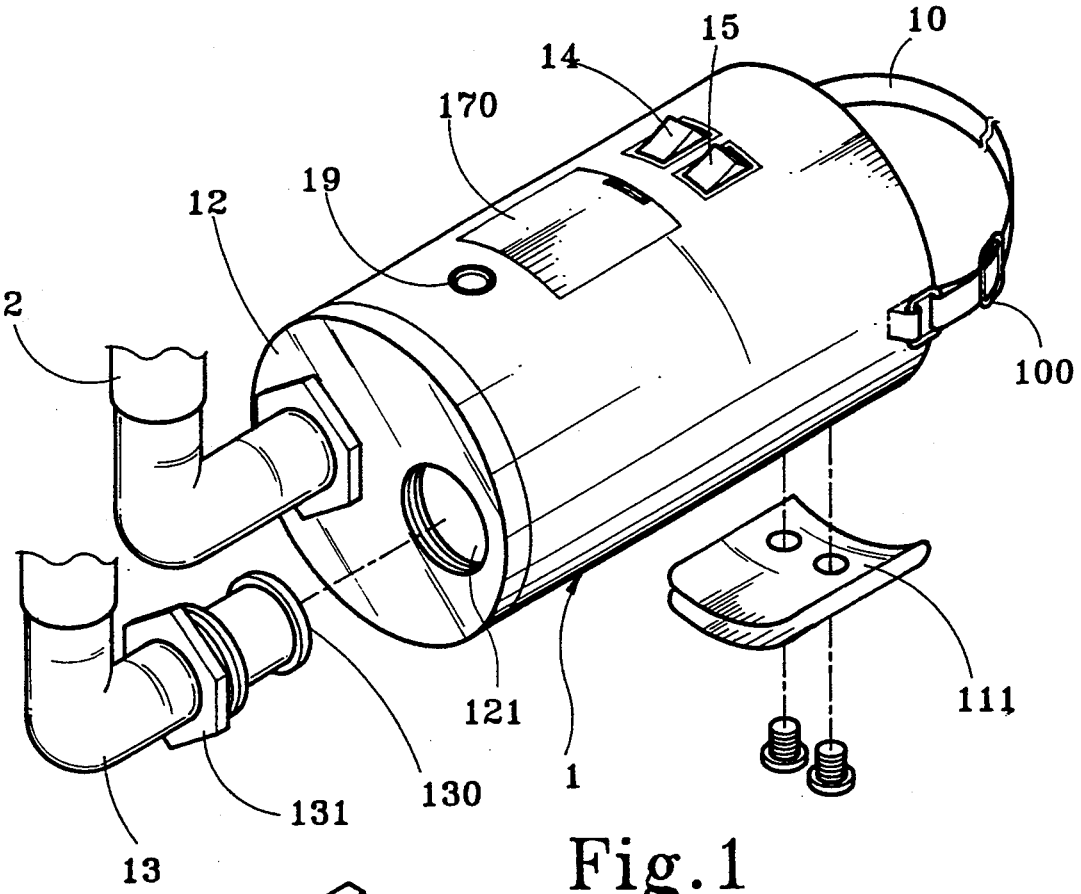
FIG. 1 shows a portable heater according to the present invention.
Figure 3:
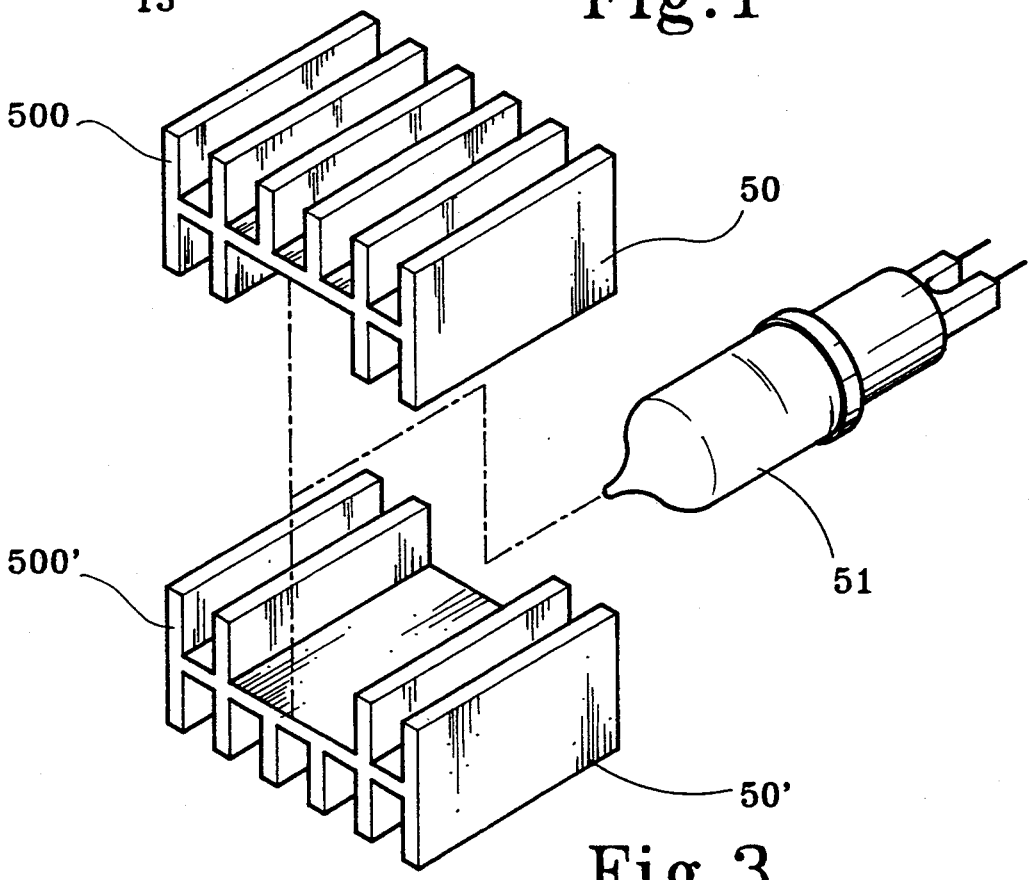
FIG. 3 is an exploded view of a heat generator for the portable heater shown in FIG. 1.
Figure 5:
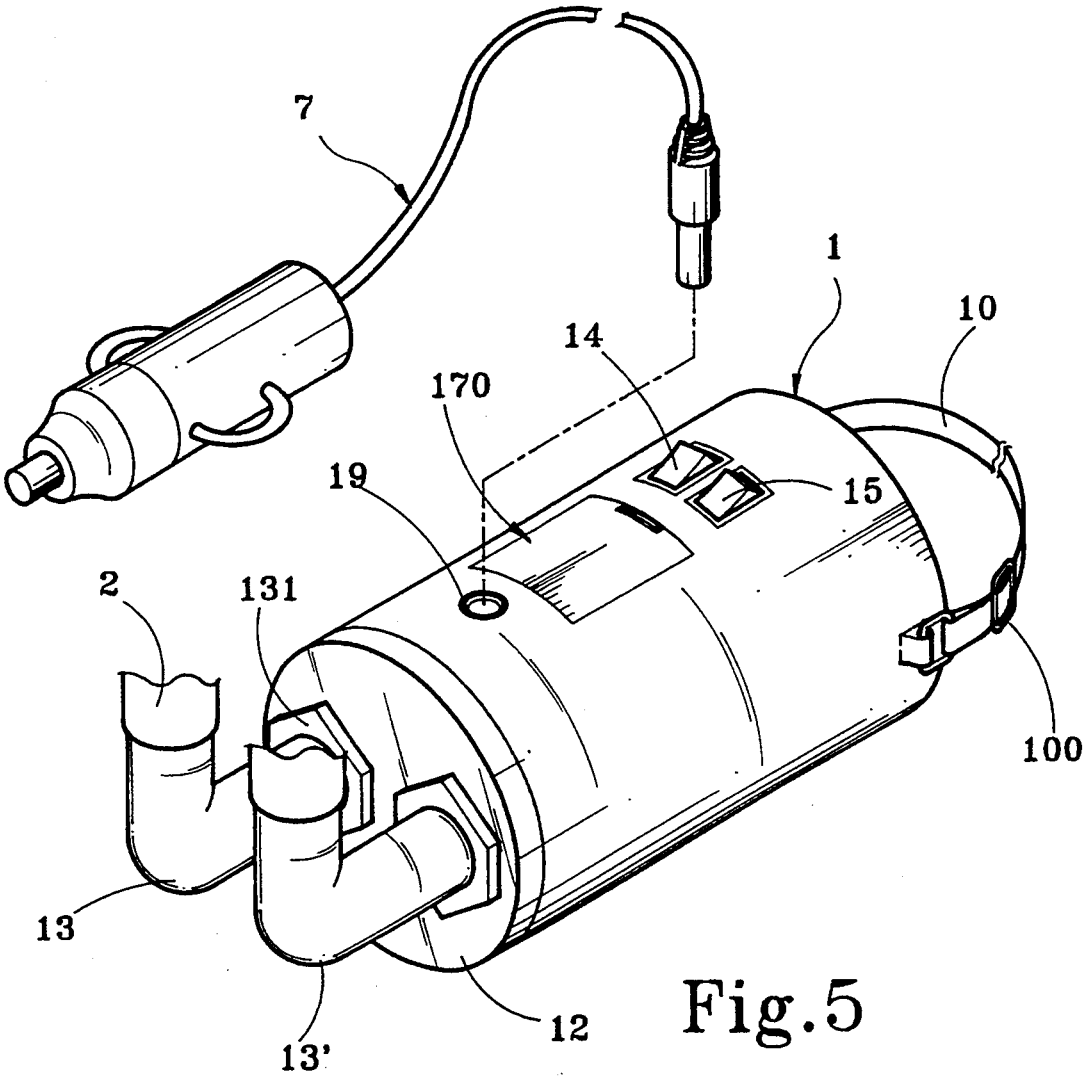
FIG. 5 shows an extension cord for connecting the DC connector of the portable heater of the present invention to the car battery power supply outlet for cigarette lighter.
Figure 2:
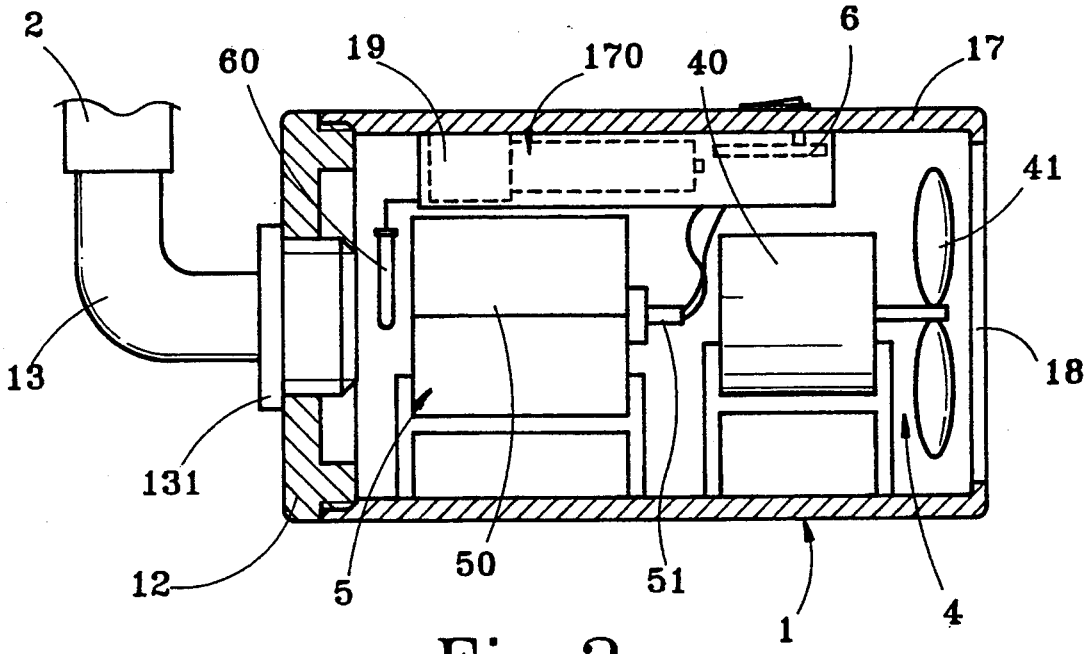
FIG. 2 is a longitudinal view in section of the portable heater shown in FIG. 1.

Referring to FIGS. 1 and 2, a portable heater 1 in accordance with the present invention comprises a cylindrical housing 17. A strap 10 is fastened to one end (the rear end) of the cylindrical housing 17 for hanging. The strap 10 has an adjustable buckle 100 for adjusting the length. A clip 111 is fixedly fastened to the periphery of the housing 17 so that the portable heater 1 can be conveniently fastened to the belt (see FIG. 4). A glass 12 is covered on the front open end of the housing 17, having a plurality of through holes 121. A plurality of pipe fittings 13 and 13' are respectively mounted on each through hole 121 by a respective mounting socket 131, particularly a swivel joint. Each pipe fitting 13 or 13' is revolvably inserted through the mounting socket 131 on either through hole 121, having an outward flange 130 at the rear end stopped inside the glass 12. The pipe fittings 13 and 13' are respectively attached with a respective air tube 2. When the fan switch 14 which is mounted outside the housing 17 is switched on, currents of air are driven out of the housing 17 through the pipe fittings 13 and 13' and guided to the desired locations by the tubes 2. When the heat switch 15 which is mounted outside the housing 17 is switched on during the delivery of currents of air through the pipe fittings 13 and 13' and the air tubes 2, hot currents of air are produced and delivered out of the housing 17 to the desired locations by the air tubes 2. When the portable heater 1 is fastened to the human body, the air tubes 2 can be inserted into the clothes to guide hot air into the space around the human body so as to keep the human body warm. More particularly during raining days, the portable heater 1 can be used to dry the inside of the raincoat or clothes. By applying hot air to the windows of the car, the portable heater 1 can remove fog from the windows. The housing 17 further comprises a DC (direct current) connector 19 for connection to the car battery power supply outlet for cigarette lighter by a extension cord 7 (see FIG. 5).

Figure 4:
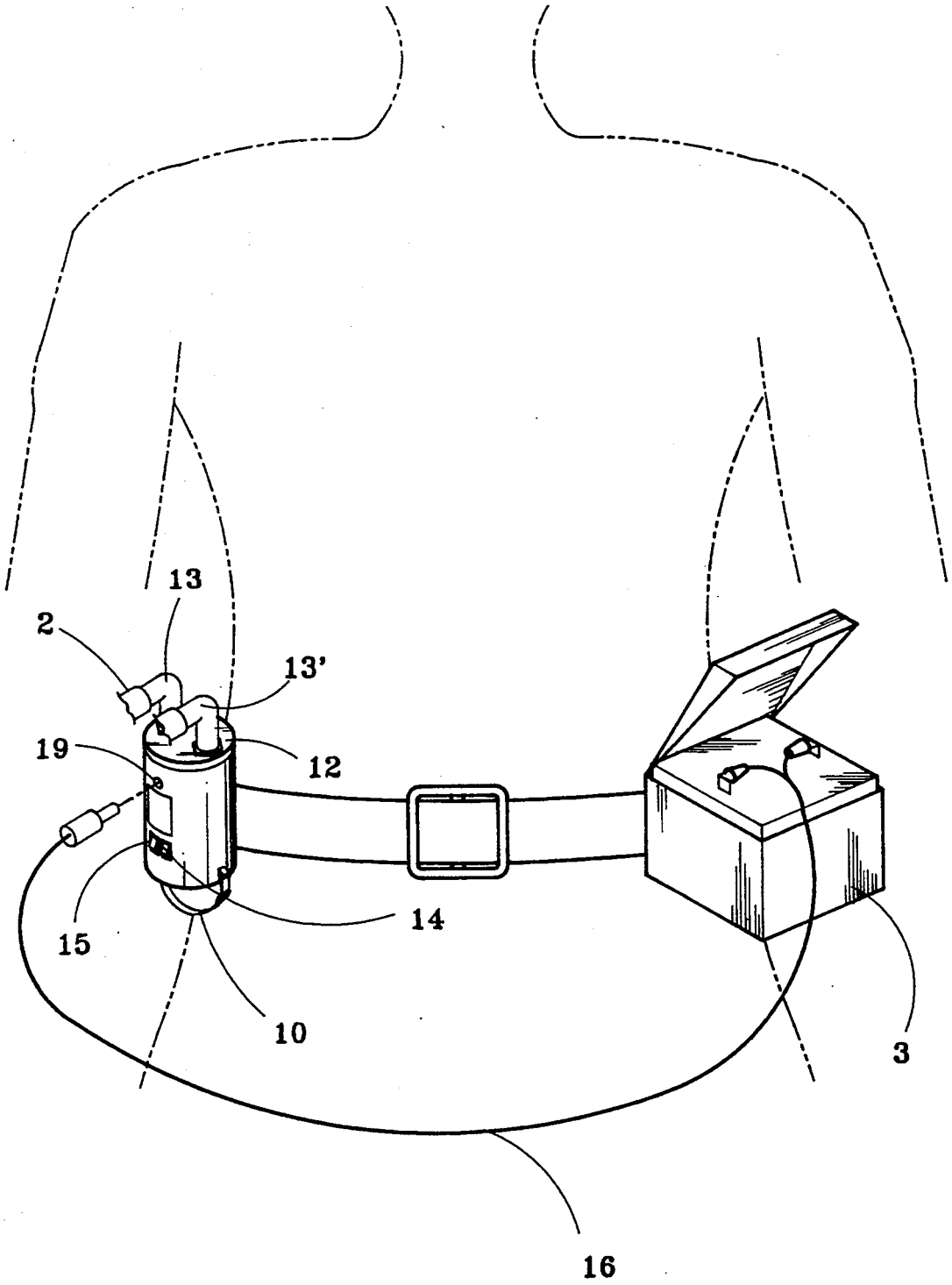
FIG. 4 shows the portable heater of the present invention fastened to the human body and connected to a portable battery box hung on the human body.

Referring to FIG. 4, a portable battery box 3 may be provided to carry a storage battery for providing DC power supply to the portable heater 1 by an electric cable 16.

Referring to FIG. 2 again, the housing 17 comprises an intake hole 18 on the rear end (opposite to the pipe fittings 13 and 13'). A fan device 4 is installed inside the housing 17 adjacent to the intake hole 18, comprised of an axial-flow fan 41 and a DC motor 40. A battery chamber 170 is made on the housing 17 at a suitable location and electrically connected to the DC connector 19. The DC motor 40 is connected to the DC connector 19 (and the battery chamber 170) through the aforesaid fan switch 14. When the fan switch 14 is switched on, electric power supply from the battery chamber 170 or an external battery power supply which is connected to the DC connector 19 is connected to the DC motor 40 causing an axial-flow air induced into the housing 17 by the axial-flow fan 41 and then sent out of the housing 17 through the air tubes 2.

Referring to FIG. 2 again, there is a heat generator 5 disposed inside the housing 17 in the route of the axial-flow of air between the pipe fittings 13 and 13' and the fan device 4 and connected to the DC connector 19 (and the battery chamber 170) through the aforesaid heat switch 15. The heat generator 5 comprises a lamp bulb 51 and a plurality of heat distribution devices 50 and 50' surrounding the lamp bulb 51. The heat distribution device 50 or 50' comprises a plurality of heat conductive radiating flanges 500 or 500'. When lamp bulb 51 is turned on by the heat switch 15, heat from the lamp bulb 51 is transmitted through the radiating flanges 500 and 500' and then carried out of the housing 17 by the axial flow of air induced by the fan device 4. There is also provided heat control device 6 mounted within the battery chamber 170 and controlled to operate by the heat switch 15. The heat control device 6 comprises a temperature detecting element 60 (such as a photoelectric resistor) disposed between the heat generator 5 and the pipe fittings 13 and 13'. When the temperature detected by the temperature detecting element 60 surpasses a predetermined value, the heat control device 6 will automatically cut off power supply from the lamp bulb 51. When the lamp bulb 51 is turned on, the light of the lamp bulb 51 penetrates through the glass 12 for illumination. Therefore, the portable heater 1 can be used as an air dryer as well as a portable lighting fixture. Furthermore, the design of the DC connector 19 enables the portable heater 1 to use the battery power supply of a motor vehicle; the design of the heat control device 6 prevents overheat of the heat generator 5 so that the service life of the heat generator 5 is prolonged.

I claim:

1. A portable heater of the type comprising a housing having an air intake at a rear end thereof and a plurality of air outlet pipes at a front end thereof, a battery power supply, a heat generator disposed inside said housing, a first switch controlled to connect said battery power supply to said heat generator causing it to produce heat, a fan device, a second switch controlled to connect said battery power supply to said fan device causing it to produce a flow of air for carrying heat from said heat generator out of said housing through said air outlet pipes, wherein said heat generator comprises a lamp bulb and at least one heat distribution device surrounding said lamp bulb and disposed between said air outlet pipes and said fan device, said at least one heat distribution device comprising each a plurality of heat conductive radiating flanges for transmitting heat from said lamp bulb; said air outlet pipes are respectively mounted on a light-permeable glass cover being covered on front end of said housing for guiding air and heat out of said housing, said light-permeable glass cover allowing the light of said lamp bulb to pass out of said housing.

2. The portable heater of claim 1 wherein said air outlet pipes are respectively mounted on a respective mounting hole on said light-permeable glass cover by a respective swivel joint.

* * * * *